US007975883B2

(12) United States Patent
Laib et al.

(10) Patent No.: US 7,975,883 B2
(45) Date of Patent: Jul. 12, 2011

(54) LIQUID CONTAINER LID WITH DISPENSING AND SEALING MECHANISM

(75) Inventors: Douglas M. Laib, Orlando, FL (US); Tom Van Vaerenbergh, Erembodegem (BE)

(73) Assignee: Dart Industries Inc., Orlando, FL (US)

( * ) Notice: Subject to any disclaimer, the term of this patent is extended or adjusted under 35 U.S.C. 154(b) by 650 days.

(21) Appl. No.: 12/076,756

(22) Filed: Mar. 21, 2008

(65) Prior Publication Data

US 2009/0236373 A1 Sep. 24, 2009

(51) Int. Cl.
*B67D 3/00* (2006.01)

(52) U.S. Cl. ..... 222/484; 222/556

(58) Field of Classification Search ..... 222/556, 222/484, 215, 210, 209, 567, 568
See application file for complete search history.

(56) References Cited

U.S. PATENT DOCUMENTS

| | | | | | |
|---|---|---|---|---|---|
| 2,688,424 | A | * | 9/1954 | Keiter | 222/215 |
| 2,764,199 | A | * | 9/1956 | Tupper | 220/254.3 |
| 3,059,816 | A | * | 10/1962 | Goldstein | 222/109 |
| 3,362,591 | A | | 1/1968 | Latham et al. | |
| 3,366,284 | A | * | 1/1968 | Marona et al. | 222/211 |
| D217,711 | S | | 6/1970 | Hazard | |
| 3,718,238 | A | * | 2/1973 | Hazard et al. | 222/536 |
| D231,083 | S | | 4/1974 | Campbell | |
| D232,809 | S | | 9/1974 | Pardo | |
| D236,429 | S | | 8/1975 | Strand | |
| 4,047,648 | A | | 9/1977 | Croyle | |
| D247,611 | S | | 3/1978 | Giles | |
| D266,311 | S | | 9/1982 | Mattheis | |
| D269,316 | S | | 6/1983 | Conti | |
| 4,503,991 | A | * | 3/1985 | Joyce | 220/838 |
| 4,782,985 | A | * | 11/1988 | Kinsley | 222/481.5 |
| 4,887,747 | A | * | 12/1989 | Ostrowsky et al. | 222/556 |
| D314,708 | S | | 2/1991 | DeCoster | |
| 5,065,909 | A | * | 11/1991 | Pino et al. | 222/484 |
| D329,608 | S | | 9/1992 | Bech | |
| 5,415,309 | A | | 5/1995 | Wang | |

(Continued)

FOREIGN PATENT DOCUMENTS

| | | |
|---|---|---|
| CH | 277946 | 12/1951 |

(Continued)

OTHER PUBLICATIONS

Three digital images showing the seal plate of the cover for a container claimed in U.S. Design Patent No. D545,619 in an open position (Jul. 13, 2007).

*Primary Examiner* — Kevin P Shaver
*Assistant Examiner* — Donnell Long

(57) ABSTRACT

A liquid container lid for use on a container is disclosed having a pouring spout disposed on an upper surface of the lid, a vent hole disposed on the upper surface of the lid and rear of the pouring spout, a pair of U-shaped lugs disposed on the upper surface of the lid and rear of the vent hole, a seal plate having a trunnion on a lower surface thereof, and a post extending downwardly from the lower surface and opposing the trunnion, a gasket removably disposed over the post on the seal plate, the trunnion of the seal plate pivotally engaging the pair of U-shaped lugs, allowing the seal plate to pivot in a cantilevered motion from a first raised position to a second lowered position wherein the gasket is inserted in the pouring spout and seals the pouring spout.

20 Claims, 5 Drawing Sheets

U.S. PATENT DOCUMENTS

| | | | | |
|---|---|---|---|---|
| D360,576 | S | | 7/1995 | Bech |
| 5,579,961 | A | * | 12/1996 | Zimmerman ..... 222/545 |
| 5,699,841 | A | | 12/1997 | Takagawa |
| 5,709,318 | A | * | 1/1998 | Oder ..... 222/153.06 |
| 5,740,914 | A | | 4/1998 | Herzog |
| 5,762,228 | A | | 6/1998 | Morgan et al. |
| 5,769,229 | A | | 6/1998 | Andress et al. |
| D398,533 | S | | 9/1998 | Kotyuk, Jr. et al. |
| D411,408 | S | | 6/1999 | Ahern, Jr. et al. |
| D415,420 | S | | 10/1999 | Chen |
| D417,583 | S | | 12/1999 | Demore |
| D418,364 | S | | 1/2000 | Demore |
| D427,909 | S | | 7/2000 | Doritty et al. |
| 6,273,291 | B1 | | 8/2001 | Conti |
| D451,807 | S | | 12/2001 | Goettner |
| D456,265 | S | | 4/2002 | Spear |
| D475,621 | S | | 6/2003 | Buchalski et al. |
| D520,371 | S | | 5/2006 | Clamage |
| D539,655 | S | | 4/2007 | Kipperman et al. |
| D539,657 | S | | 4/2007 | Webb et al. |
| D545,619 | S | | 7/2007 | Jalet |
| D546,188 | S | | 7/2007 | Penfold et al. |
| D546,694 | S | | 7/2007 | Penfold et al. |
| D547,661 | S | | 7/2007 | Blasko et al. |
| 7,264,135 | B2 | | 9/2007 | Savicki et al. |
| D556,576 | S | | 12/2007 | Webb |
| 2003/0136783 | A1 | | 7/2003 | Hatsumoto et al. |
| 2004/0182860 | A1 | | 9/2004 | Wu et al. |
| 2007/0075081 | A1 | * | 4/2007 | Stokes ..... 220/212 |
| 2007/0102390 | A1 | | 5/2007 | Hoepner et al. |
| 2007/0151993 | A1 | | 7/2007 | Yelland |

FOREIGN PATENT DOCUMENTS

| | | |
|---|---|---|
| GB | 16303 | 10/1894 |
| JP | 332312 | 5/1971 |

* cited by examiner

LIQUID CONTAINER LID WITH DISPENSING AND SEALING MECHANISM

TECHNICAL FIELD

The present invention is directed toward a container lid, and more particularly, toward a liquid container lid with a pouring spout and having a sealing mechanism with a gasket for the pouring spout.

BACKGROUND OF THE INVENTION

Prior art liquid dispensing container lids generally include a sealing member and a pour spout for dispensing liquids.

One of the shortcomings of some prior art liquid dispensing container lids is the lack of an easily operated sealing mechanism to seal the pour spout by the user.

Yet another shortcoming of some prior art liquid dispensing container lids is the lack of having a sealing gasket made of silicone for sealing the pouring spout, and a vent hole separate from the pouring spout to allow for easy dispensing and pouring of the liquid contents.

It is therefore a primary object of the present invention to provide a liquid container lid having a sealing mechanism that is easily operated by the user using a single hand for both holding the container and operating the sealing mechanism.

It is a further object of the present invention to provide a silicone gasket for the pouring spout of a liquid container lid having a separate vent hole.

SUMMARY OF THE INVENTION

These problems and others are addressed by the present invention which comprises a liquid container lid for use on a container and having a pouring spout disposed on an upper surface of the lid, a vent hole disposed on the upper surface of the lid and rear of the pouring spout, a pair of U-shaped lugs disposed on the upper surface of the lid and rear of the vent hole, a seal plate having a trunnion on a lower surface thereof, and a post extending downwardly from the lower surface and opposing the trunnion, a gasket removably disposed over the post on the seal plate, the trunnion of the seal plate pivotally engaging the pair of U-shaped lugs, allowing the seal plate to pivot in a cantilevered motion from a first raised position to a second lowered position wherein the gasket is inserted in the pouring spout and seals the pouring spout.

BRIEF DESCRIPTION OF DRAWINGS

These and other objects of the present invention will be appreciated and understood by those skilled in the art from the detailed description of the preferred embodiments of the invention and the following drawings of which.

DETAILED DESCRIPTION OF THE INVENTION

Figure 1:
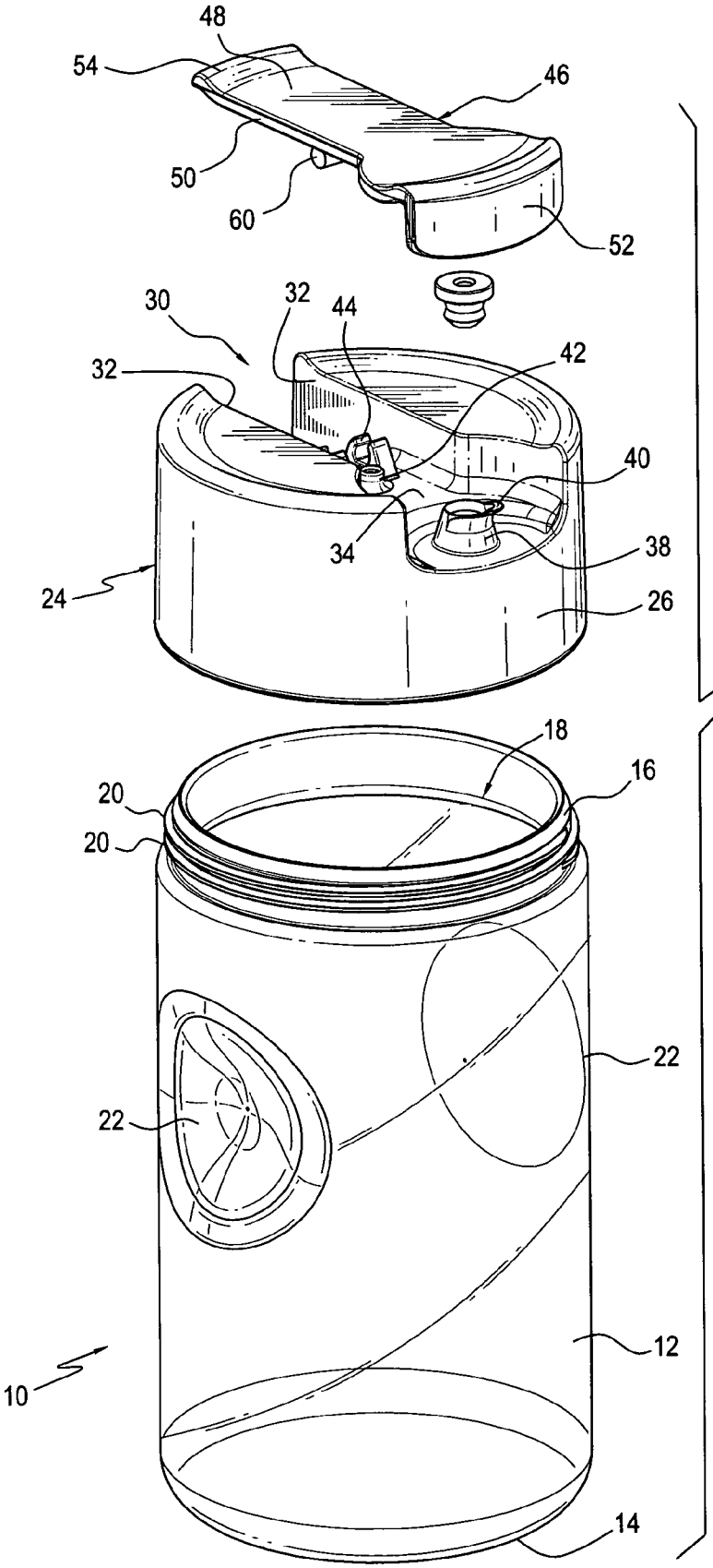
FIG. 1 is an exploded view of a container together with a container lid and sealing mechanism in accordance with the preferred embodiment of the present invention.
Figure 2:
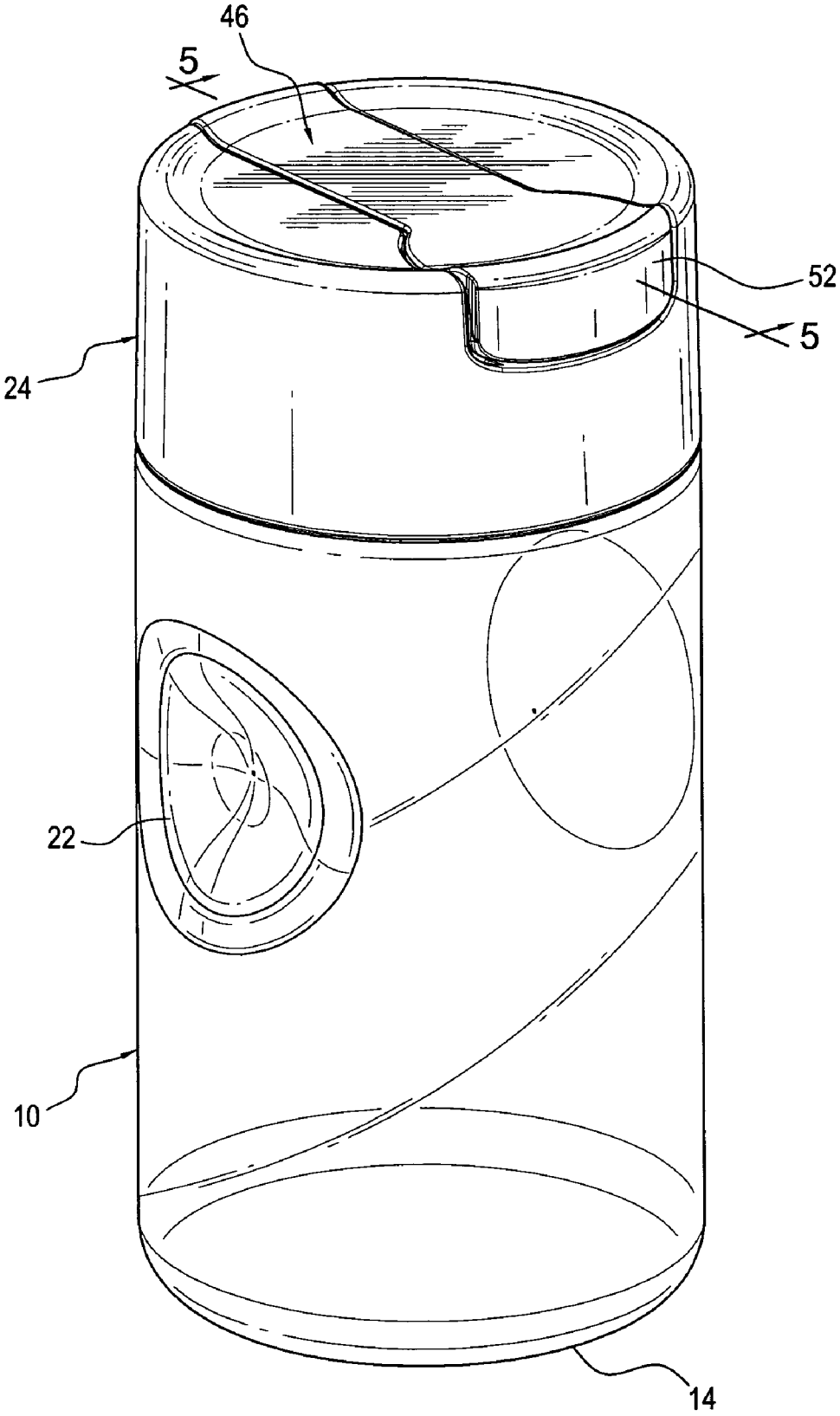
FIG. 2 is a perspective view of the combination container and container lid with the container lid secured on the container and the sealing mechanism in a closed position.
Figure 3:
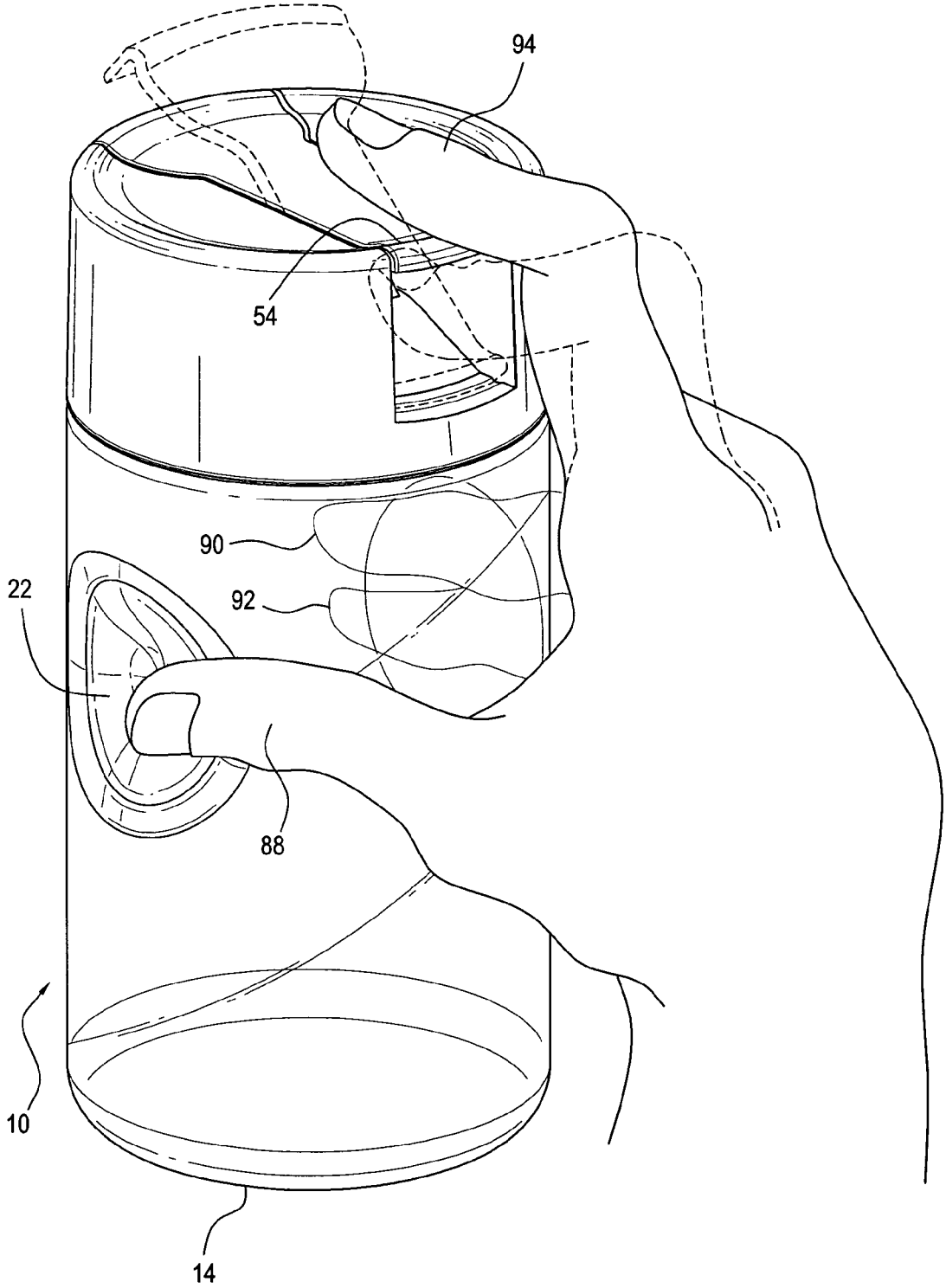
FIG. 3 is a perspective view of the combination container and container lid with the sealing mechanism in an opened position illustrating the one hand operation thereof.

Referring now to the drawings, and more specifically FIGS. 1-3, wherein the showings are for the purpose of illustrating the preferred embodiment of the invention only and not for the purpose of limiting the same, a container for holding liquid contents, such as, but not limited to, soy sauce, is generally shown at 10 having a substantially cylindrical configuration including an outer wall 12, a bottom 14, and a top peripheral rim 16 bounding an opening 18 for providing access inside the container 10. A top peripheral rim 16 includes a plurality of outer threads 20 which, as will be explained herein, engages the corresponding threads on the lid.

A pair of opposing dimples or depressions 22 each having a substantially circular configuration is disposed on or integral with the outer wall 12 of the container, and are positioned proximate and below the peripheral rim 16. As will be explained herein in greater detail, the pair of opposing dimples 22 provides a better grip for the user's fingers to utilize the one-hand operation of the sealing mechanism.

Figure 4:
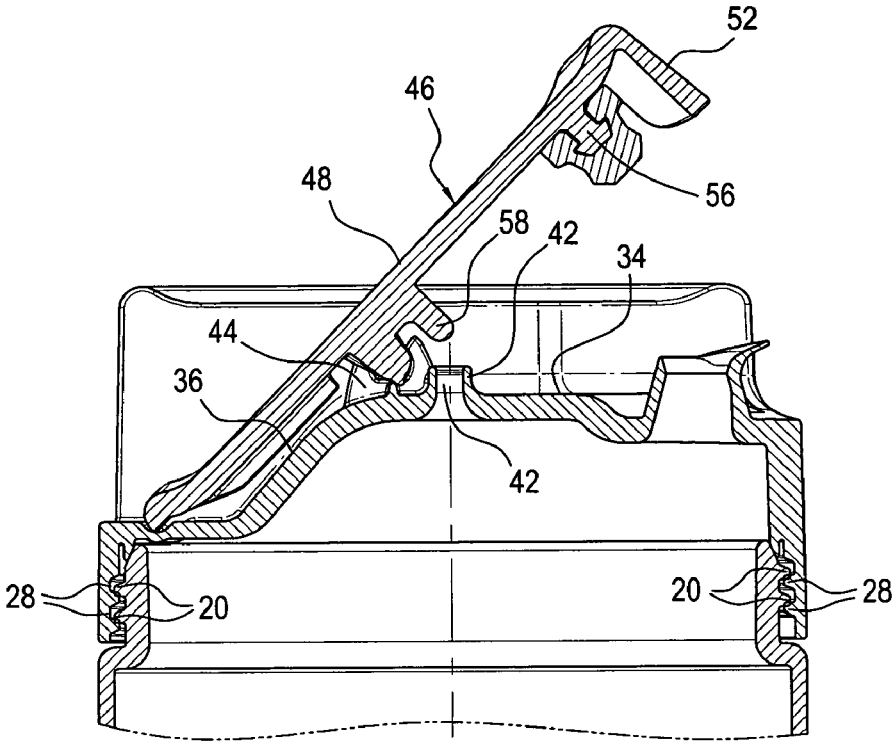
FIG. 4 is a cross-sectional view of the container lid with the sealing mechanism in an opened position.
Figure 5:
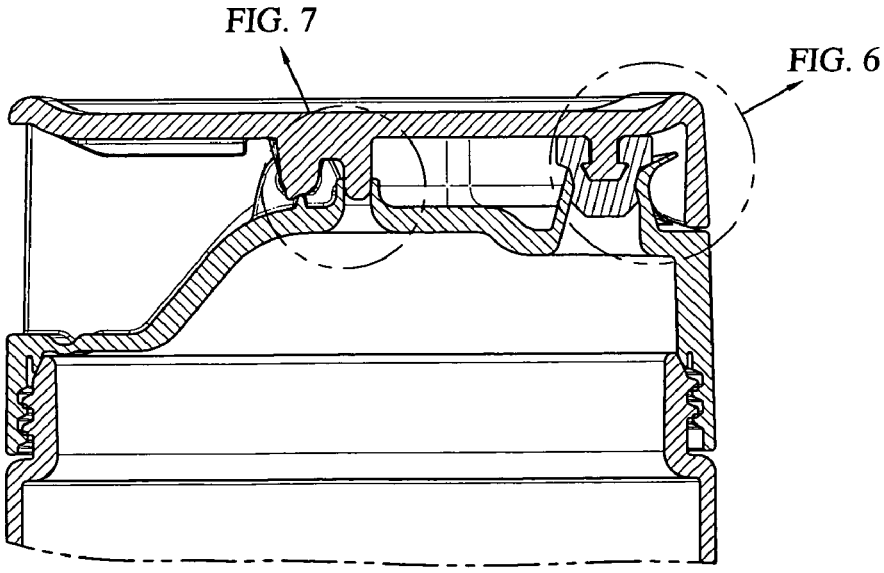
FIG. 5 is a cross-sectional view of the container lid with the sealing mechanism in a closed position.

Referring now to FIGS. 1 and 4-5, a lid is generally illustrated at 24 having a substantially cylindrical shape and configuration with a diameter of the same size as the diameter of the container, and further includes an outer wall 26 with a plurality of inner threads 28 on a lower portion thereof for releasably engaging the plurality of threads 20 on the container top peripheral rim 16 to removably secure the lid 24 on the container 10.

The lid 24 includes a lateral cut out portion 30 spanning the diameter of the lid 24 bounded by a pair of opposing walls 32, and further comprises a lower flat surface portion 34 and sloped rear surface portion 36. A pouring spout 38 is integral with and extends upwardly from the lower flat surface portion 34. The pouring spout 38 includes a pouring lip 40 affixed to its upper periphery. A vent hole 42 is also positioned and extends upwardly from the lower flat surface portion 34 rear of the pouring spout 38. A pair of U-shaped lugs 44 is integral with and extends upwardly from the lower flat surface portion 34. The U-shaped lugs 44 are positioned rear of the vent hole 42. Therefore, as best seen in FIG. 1, the vent hole 42 is positioned between the pouring spout 38 and the pair of U-shaped lugs 44 on the lower flat surface portion 34 of the lid 24. It is noted that an alternative embodiment (not shown) contemplates having an enlarged pouring spout instead of the vent hole such that the container could simultaneously vent through the pouring spout while the liquid is being poured.

Referring now to FIGS. 4 and 5, the sealing mechanism is explained. The sealing mechanism primarily comprises a seal plate 46 having a substantially rectangular shape and configuration with an upper surface 48 and a lower surface 50. A front and downwardly extending flange 52 is dimensioned substantially to that of the depth of the lateral cut-out portion 30 so that when seal plate 46 is in a closed portion, the lid will have a complete cylindrical configuration. A lateral raised portion 54 is positioned at the rear of the seal plate 46 to provide for a better grip for the user's finger in order to pivotally operate the seal plate 46.

A gasket receiving post 56, the structural details of which will be explained herein in greater detail, is integral with and extends downwardly from the lower surface 50 of the seal plate 46. A vent closing post 58 having a cylindrical shape and configuration is also integral with and extends downwardly from the lower surface 50 of the seal plate 46, and is positioned to be received within and close off the vent hole 42 when the seal plate 46 is in a closed position. A trunnion 60 is integral with the lower surface 50 of the seal plate 46, is positioned rear of the vent closing post 58, and is removably received within the pair of U-shaped lugs 44. The trunnion 60 pivots within the pair of U-shaped lugs 44 allowing the seal plate to have a cantilevered pivoting motion between in a first raised position and a second lowered position.

Figure 7:
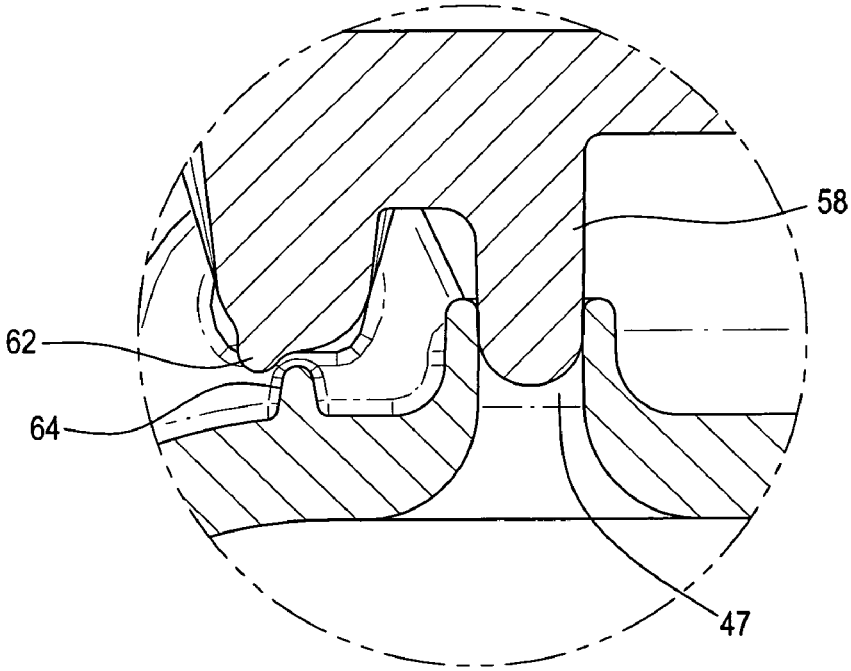

As best seen in FIG. 7, the trunnion 60 includes a cam 62 which engages a protrusion 64 extending upwardly from the lower flat surface portion 34 in a wedge-like fit and maintains the seal plate 46 locked in when it is in a lowered and closed and sealing position.

Figure 6:
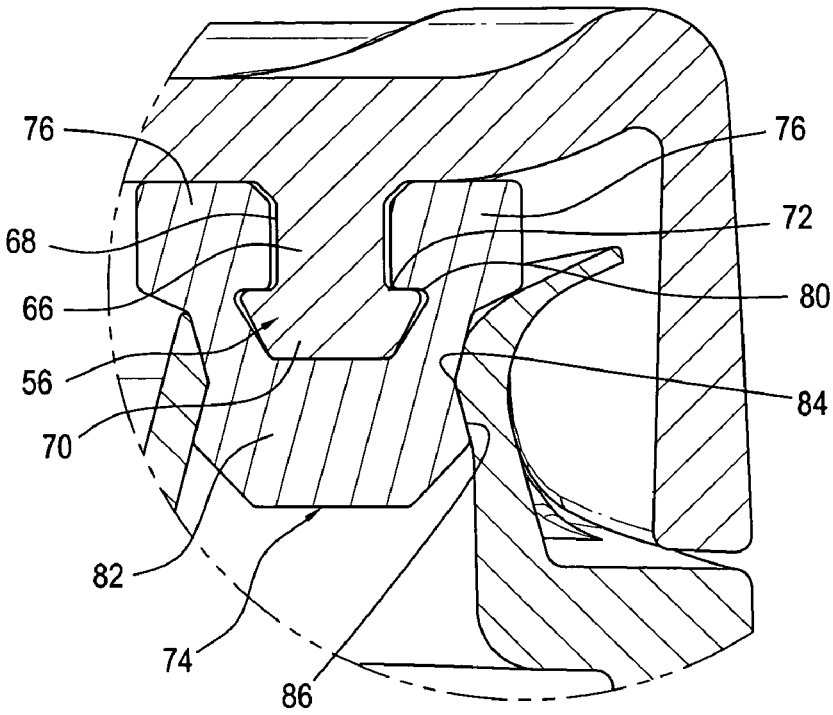
FIG. 6 is an enlarged cross-sectional view of the gasket for the sealing mechanism in a closed position shown in FIG. 5; and, FIG. 7 is an enlarged cross-sectional view of pivot structure of the sealing mechanism and the vent hole shown in FIG. 5.

Referring now to FIG. 6, the gasket receiving post 56 includes an elongate cylindrical body 66 integral with and extending downwardly from the lower surface 50 of the seal plate 46, and further includes an outer wall 68. The gasket receiving post 56 has a frusto-conically shaped head 70 integral with and extending downwardly from the elongate cylindrical body 66, and includes a larger diameter than that of the elongate cylindrical body 66, therefore creating a stepped area 72 at the connection point between the head and the cylindrical body.

A gasket 74 is illustrated as being secured over the frusto-conically shaped head 70. The gasket 74 is preferably made from approved silicone or other flexible and resilient material. The gasket 74 includes an annular rim 76 having a substantially rectangular cross section bounding an opening 78 having the same shape and configuration as the frusto-conically shaped head 70 for receiving the same therewithin. The annular rim 76 includes an undercut portion 80 which engages the stepped area 72, thereby securing the gasket 74 over the gasket receiving post 56.

The gasket 74 further includes a sealing head 82 having an undercut area 84 that locks into and engages an undercut area 86 on the inner part of the pouring spout 38, therefore sealing the pouring spout 38. It is noted that the seal plate 46 remains in a closed lowered position with both the engagement of the undercuts on the sealing head with the undercut on the pouring spout 38, as well as the engagement of the cam 62 and protrusion 64. It is also noted that certain liquid contents of the container, such as, but not limited to, soy sauce, cooking oil, or olive oil, provide lubrication between the inner surface of the pouring spout 38 and the outer surface of gasket. As such liquids are poured from the pouring spout 38 over the pouring lip 40, a residual amount of the liquid will remain on the surface of the pouring spout 38 and lip 40. As the gasket 74 on the seal plate 46 is moved from the open to the lowered closed position, the residual amount of the liquid will act as a lubricant between the gasket 74 and pouring spout 38. The liquid will also then act as a lubricant when the user raises the seal plate and gasket from the lowered closed position to an open position.

As best seen in FIG. 3, the one hand or one finger operation of the seal plate 46 is illustrated. A user can hold the container 10 with the user's thumb 88 placed over and gripping one of the dimples 22, and the user's middle finger 90 and ring finger 92 placed over the other opposing dimple 22 while the palm of the user's hand is pressed against the outer wall 22 of the container. The user's index finger 94 of the same hand can actually press on the lateral raised portion 54 of the seal plate 46 in order to raise the seal plate 46 in a cantilevered pivoting motion which causes the gasket 74 to disengage the pouring spout 38.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto.

What is claimed is:

1. A liquid container lid for use on a container having an outer wall and an upper peripheral rim bounding an opening, said liquid container lid comprising:

a cut out portion having a sloped rear surface portion, and a flat surface portion forward of said sloped rear surface portion, a pouring spout disposed on said flat surface portion, a vent means disposed on said flat surface portion, a seal plate pivotally attached to said flat surface portion, a gasket removably disposed on said seal plate, a vent closing means on said seal plate, wherein said seal plate is pivotable in a cantilevered motion between a first lowered closed position and a second raised position, and wherein the gasket is inserted in and seals the pouring spout.

2. The liquid container lid of claim 1, wherein said vent means comprises a vent hole.

3. The liquid container lid of claim 2, wherein said vent hole is located rear of said pouring spout, and said vent closing means blocks said vent hole when said seal plate is in said first lowered closed position.

4. The liquid container lid of claim 1, further comprising a pair of U-shaped lugs disposed on said surface portion and rear of said vent means.

5. The liquid container lid of claim 4, wherein the seal plate further comprises a trunnion integral with a lower surface of the seal plate.

6. The liquid container lid of claim 5, wherein said trunnion of said seal plate pivotally engages said pair of U-shaped lugs, and wherein said trunnion is positioned rear of said vent closing means.

7. The liquid container lid of claim 5, wherein said vent closing means is a post integral with and extending downwardly from said lower surface of said seal plate, and wherein said post is dimensioned and configured to be received in said vent hole in order to seal said vent hole.

8. The liquid container lid of claim 1, wherein the gasket is made of silicone.

9. The liquid container lid of claim 1, wherein said container further comprises a pair of opposing depressions disposed on said outer wall proximate and below said upper peripheral rim.

10. The liquid container lid of claim 1, wherein said lid is threadably and removably secured on said container.

11. The liquid container lid of claim 6, further comprising a protrusion extending upwardly from said flat surface portion, and wherein said trunnion includes a cam which engages said protrusion in a wedge-like fit to maintain the seal plate locked in place when in a lowered position.

12. The liquid container lid of claim 1, further comprising a gasket receiving post integral with and extending downwardly from the lower surface of the seal plate, wherein said gasket is removably received over said gasket receiving post.

13. The liquid container lid of claim 12, wherein said gasket further comprises a sealing head having an undercut area, said pouring spout having a second undercut area on an inner part thereof, and wherein said undercut area on said sealing head locks into and engages said second undercut area on said inner part of the pouring spout.

14. The liquid container lid of claim 1, wherein said cut out portion diametrically spans an upper portion of said lid, wherein said cut out portion is defined by a pair of opposing walls, and wherein said flat surface portion is a horizontal surface portion.

15. A liquid container lid for use on a container having an outer wall and an upper peripheral rim bounding an opening, said liquid container lid comprising:

a cut out portion having a sloped rear surface portion, and a flat surface portion forward of said sloped rear surface portion, a pouring spout disposed on said flat surface portion, a vent means disposed on said flat surface portion, a seal plate pivotally attached to said flat surface portion, a gasket removably disposed on said seal plate, a vent closing means on said seal plate, wherein said seal plate is pivotable in a cantilevered motion, wherein said container and said container lid are dimensioned and configured such that a user can grasp said container by one hand and simultaneously press said seal plate to move said seal plate from a first lowered closed position to a second raised open position.

16. The liquid container lid of claim 15, further comprising a pair of opposing depressions disposed on said outer wall proximate and below said upper peripheral rim, and wherein said container is grasped by the user's thumb, middle and ring fingers over said opposing depressions, and the user's index finger is used to depress said seal plate.

17. The liquid container lid of claim 15, wherein said cut out portion diametrically spans an upper portion of said lid, wherein said cut out portion is defined by a pair of opposing walls, and wherein said flat surface portion is a horizontal surface portion.

18. A method of operating a container lid sealing mechanism, comprising:

providing a cut out portion having a sloped rear surface portion, and a flat surface portion forward of said sloped rear surface portion, providing a pouring spout on said flat surface portion, providing a vent hole on said flat surface portion, and rear of said pouring spout, providing a pair of U-shaped lugs on said flat surface portion, and rear of said vent hole, providing a seal plate having a trunnion on the lower surface of said seal plate, providing a post extending downwardly from the lower surface and opposing said trunnion, providing a gasket removably disposed on said post on the seal plate, pivotally moving said seal plate on said trunnion and U-shaped lugs in a cantilevered motion from a first closed and lowered position to a second raised position by grasping the container with one hand and at the same time pressing the seal plate with the index finger of the same hand, thus causing a lower rear surface of the seal plate to be received by the sloped rear surface portion as the seal plate moves to the raised position.

19. The method of claim 18, wherein said cut out portion diametrically spans an upper portion of said lid, said cut out portion being defined by a pair of opposing walls, and wherein a rear, lower surface portion of the seal plate is rocked in a downward motion toward the sloped rear surface when the seal plate is pivoted to the second raised position.

20. The method of claim 18, wherein said flat surface portion is a horizontal surface portion.

* * * * *